United States Patent [19]

Brandes et al.

[11] 4,145,996

[45] Mar. 27, 1979

[54] VAPOR GENERATOR

[75] Inventors: Hermann Brandes, Dinslaken; Heino Martin, Oberhausen, both of Fed. Rep. of Germany

[73] Assignee: Deutsche Babcock Aktiengesellschaft, Fed. Rep. of Germany

[21] Appl. No.: 820,747

[22] Filed: Aug. 1, 1977

[30] Foreign Application Priority Data

Aug. 5, 1976 [DE] Fed. Rep. of Germany ..... 2635210

[51] Int. Cl.[2] ..... F22B 37/24

[52] U.S. Cl. ..... 122/6 A; 122/494; 122/510

[58] Field of Search ..... 122/6 A, 235 A, 235 T, 122/448 B, 33, 478, 494, 510

[56] References Cited

U.S. PATENT DOCUMENTS

| | | | |
|---|---|---|---|
| 1,912,938 | 6/1933 | Grebe | 122/33 |
| 3,196,842 | 7/1965 | Huge et al. | 122/235 |
| 3,479,994 | 11/1969 | Kreider et al. | 122/494 |
| 3,850,149 | 11/1974 | Piaskowski | 122/494 |

*Primary Examiner*—Kenneth W. Sprague
*Attorney, Agent, or Firm*—McGlew and Tuttle

[57] ABSTRACT

A vapor generator is made up of a tube wall with conducting tubes which are gas-tightly welded together followed by a sheet metal flue gas duct leading to a stack. The tube wall has a temperature zone in which the temperature difference between the medium in the tubes and the flue gas is at its minimum under any operational conditions. In addition to the conducting tubes, the tube wall has a portion with non-conducting tubes which are gas-tightly welded together and through which the medium is non conducted. The non-conducting tubes are aligned with respective tubes of the conducting portion of the tube wall with the interposition of tube transition pieces or T-shape pieces. The T-shape transition pieces include a connection to the conducting tube with a right angle tube leg for the offtake of the vapor and an aligned leg which is welded to the non-conducting tubes of the non-conducting tube section.

10 Claims, 4 Drawing Figures

VAPOR GENERATOR

FIELD AND BACKGROUND OF THE INVENTION

This invention relates in general to vapor generators and, in particular, to a new and useful steam generator, comprising tube walls which are gas-tightly welded together and followed by a sheet metal flue duct leading to the stack.

DESCRIPTION OF THE PRIOR ART

The zone of transition between the heated tube wall and the sheet metal duct in vapor generators of the prior art is formed by compensators which have to absorb the variations in expansion of the adjoining structural parts. Experience has shown that in many plants, the compensators are incapable of absorbing the variations in expansion and they crack, particularly under frequently varying loads.

SUMMARY OF THE INVENTION

The present invention is directed to a design of the transition zone in a vapor generator which prevents the formation of any tension cracks.

To this end, and in accordance with the invention, it is provided that in the temperature zone in which the temperature difference between the medium in the tubes and the flue gas is at its minimum under any operational conditions, the tube wall is followed by another tube wall of equal elasticity, through which the medium is not conducted. The sheet metal flue gas duct can be connected directly, without any problems, to this non-conducting tube wall, since both of these parts have the same temperature, namely, the temperature of the flue gases.

In this way, exactly defined stress conditions are obtained in the transition zone which are calculable and, therefore, can be mastered. The temperature differences between the medium and the flue gases, which have been present in the conducting tube wall equalize in the non-conducting tube wall, so that the non-conducting tube wall takes up the temperature of the flue gases. As to mechanical resistance, the structure of the transition zone is without problems, since the structural parts which are welded to each other are of equal elasticity. It is further advantageous that the same reinforcing structural elements can be used without transition pieces both for the conducting and for the non-conducting tube walls.

The spacing of the tubes in the conducting and non-conducting walls is preferably identical. In such a case, the transition can simply be formed by T-shape pieces which are provided with ribs and in which one of the tube legs is only partially bored while the bore of the opposite tube leg communicates with the bore of the branched leg. Such T-shape pieces also serve to remove the steam generated in the conducting tube wall, and as a connection to the non-conducting tube wall.

Accordingly, an object of the invention is to provide a vapor generator which comprises wall means which define at least one pass, a stack, a flue gas duct leading to the stack and connected to the gas passes, and wherein, the tubes of the wall defining the pass include vapor-conducting tubes gas-tightly welded together and non-conducting tubes aligned with the vapor conducting tubes following the tubes toward the flue gas duct and wherein the non-conducting tubes are gas-tightly welded together and do not conduct any vapor and are located in a region in which the temperature of the vapor or medium is substantially equal to the temperature of the flue gases.

Another object of the invention is to provide a construction for furnaces which includes tubular transition pieces connected between non-conducting and vapor-conducting tubes of the wall of a gas pass, with the non-conducting tubes being located adjacent the flue gas duct leading to the stack and wherein the transition pieces include a right angular leg portion for conducting away the vapor and an aligned leg portion for aligning the tubes which do not conduct the vapor with those of the conducting type.

A further object of the invention is to provide a vapor generator which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there are illustrated preferred embodiments of the invention.

DESCRIPTION OF THE PREFERRED EMBODIMENTS

Figure 1:
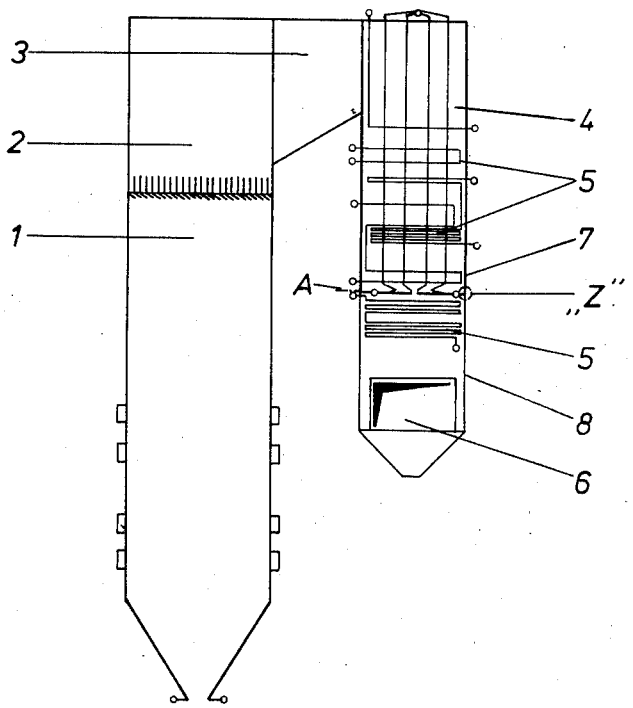
FIG. 1 is a schematic vertical sectional view of a two-pass boiler constructed in accordance with the invention.
Figure 2:
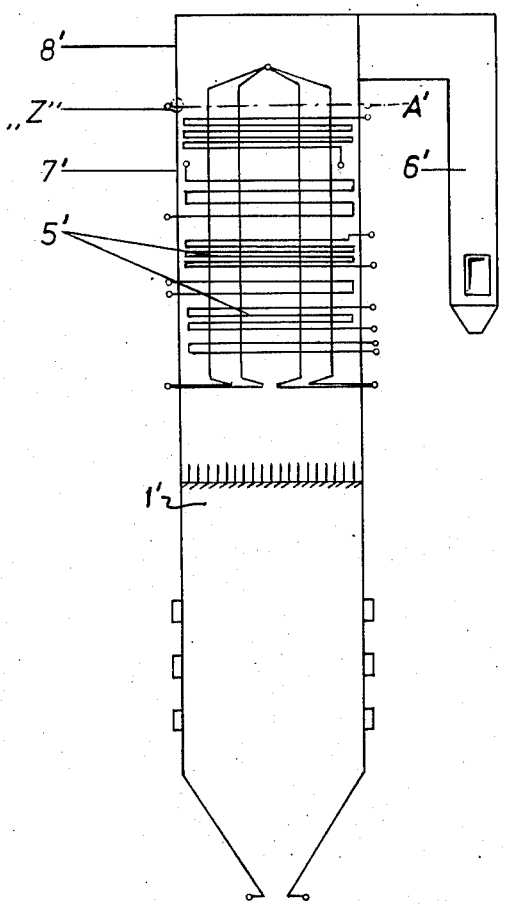
FIG. 2 is a view similar to FIG. 1 showing a tower-type boiler constructed in accordance with another embodiment of the invention.

Referring to the drawings in particular, the invention embodied therein, comprises in each embodiment of FIGS. 1 and 2, a vapor generator which has at least one first pass 1 and 1'. In the embodiment of boiler shown in FIG. 1, the first pass 1 is followed by a second pass 4 via a transverse flue 3. In each embodiment, the passes lead to a sheet metal flue 6 or 6' leading to the stack.

The tube walls of the boiler are built up of tubes 7 which are gas-tightly welded to one another through intermediate flats 14. In the construction of FIG. 1, the lateral walls of the first pass are formed in the lower part 1, substantially surrounding the firing space, of an ascending spiral which is followed, in the upper part 2, by a vertical tubing. The first pass 1 with upper part 2 communicates with the second pass 4 through a transverse flue 3. Ancillary heating surfaces 5 are provided in the second pass 4, in a manner known per se. Second pass 4 is connected to a sheet metal duct 6 leading to the stack (not shown).

The second pass 4 is formed of a gas-tightly welded tube wall 7 conducting the medium, only down to a certain level. In FIGS. 1 and 2, this level is indicated by a plane A. It is the zone in which under any operational conditions, the temperature differences between the medium flowing through a conducting tube wall 7 and the flue gas are at their minimum.

The tubes are brought out from the conducting tube wall 7 in plane A, and are connected, for example, to a header, (not shown) wherefrom the steam is recycled into the tube system of the boiler. Conducting tube wall 7 is followed, without any transition, by a lower non-conducting tube wall 8 which is built up in the same manner as wall 7 of tubes which are gas-tightly welded to one another through intermediate flats 14. Lower tube wall 8 has the same elasticity as tube wall 7, but it does not conduct the medium.

Figure 4:
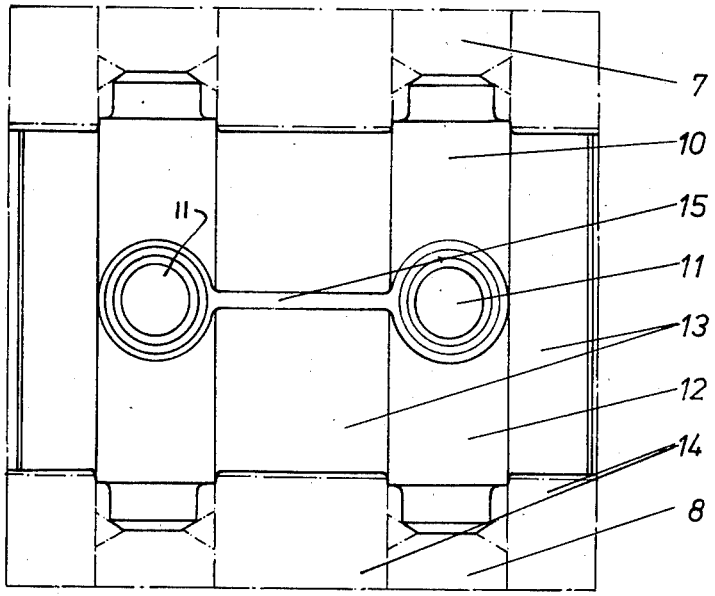
FIG. 4 is an elevational view of the transition piece shown in FIG. 3.
Figure 3:
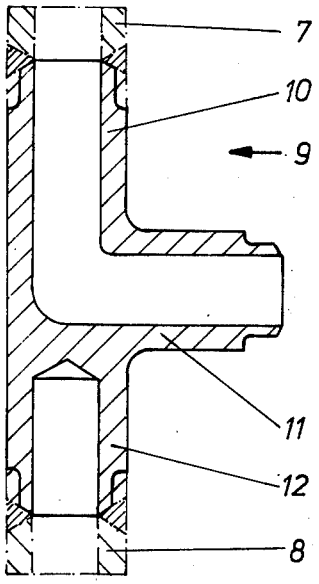
FIG. 3 is a detailed section taken in the vicinity of the area marked Z in FIGS. 1 and 2, showing the transition tubular pieces for both embodiments.

The spacing of the tubes in the conducting wall 7 is identical with the spacing of the tubes in the non-conducting wall 8. Transition tube pieces or T-shape pieces 9 are gas-tightly welded in both of the tube walls 7 and 8, and form the transition between the two tube walls. T-shape pieces 9 are shown in FIGS. 3 and 4, where it is indicated at the same time how the tees 9 are gas-tightly inserted in tube walls 7 and 8.

The T-shape pieces 9 include tube legs 10 which are connected to the tubes of conducting tube wall 7 and communicate with branch legs 11 disposed at right angles thereto. Branch legs 11 are connected to tubes which lead to the header (not shown). An opposite leg 12 is aligned with leg 10 of T-shape piece 9 and it is only partially bored. The tubes of the non-conducting tube wall 8 are welded to legs 12. Legs 10 and 12 of T-shape pieces 9 are connected to each other by ribs 13 which extend in the plane of legs 10 and 12.

Ribs 13 are welded to the flats 14 of tube walls 7 and 8 so that these walls are gas-tightly connected together and to each other. Branch legs 11 of T-shape pieces 9 which project from tube wall 7 in the assembled state are connected to each other by cross-ribs 15 extending therebetween. Thus, the T-shape pieces 9 form not only the transition structure between the conducting and non-conducting tube walls, but, at the same time, serve to remove the steam generated in tube wall 7.

For reasons of mechanical resistance, tube wall 8 should not have a height smaller than 300 mm. Its height may amount up to 3,000 mm, depending on the size of the boiler. The same reinforcing and suspension elements are used for both the conducting tube wall 7 and the non-conducting tube wall 8. Non-conducting tube wall 8 takes up the temperature of the flue gases. Consequently, sheet metal flue gas duct 6 can be joined directly to non-conducting tube wall 8.

FIG. 2 shows the inventive arrangement of the transition from the tube wall to the sheet metal flue gas duct 6′ in a tower-type boiler. Here again, the plane A′ up to which the conducting tube wall 7′ extends is predetermined by the condition that here the difference between the temperatures of the flue gas and the medium is at its minimum. Conducting tube wall 7′ is followed by non-conducting tube wall 8′ above plane A′, to which flue gas duct 6′ leading to the stack is connected.

While specific embodiments of the invention have been shown and described in detail to illustrate the application of the principles of the invention, it will be understood that the invention may be embodied otherwise without departing from such principles.

What is claimed is:

1. In a vapor generator having a pass with a flue gas inflow end and an opposite flue gas outflow end, a first tube wall portion in said pass with first conducting tubes gas-tightly welded together, a flue gas duct having one end connected to said gas outflow end of said pass and an opposite end, a stack connected to said opposite end of said flue gas duct, said pass having a temperature zone in which the temperature difference between the medium in said first conducting tubes and the flue gas is at its minimum in operation, the improvement comprising a second tube wall in said pass spaced from said first tube wall portion in a direction toward said stack and having second non-conducting tubes gas-tightly welded together and through which the medium is not conducted and being of substantially the same elasticity as said first conducting tubes.

2. In a vapor generator, the improvement claimed in claim 1, wherein said flue gas duct is directly connected to said second tube wall portion having the non-conducting tubes.

3. In a vapor generator, the improvement claimed in claim 1, wherein said first tube wall portion conducting tubes and said second tube wall portion non-conducting tubes are spaced apart equally.

4. In a vapor generator, the improvement claimed in claim 1, including a transition member connected between the conducting and non-conducting tubes comprising a T-shape tubular structure having a leg portion connected to the conducting tubes with a branch leg portion communicating therewith extending away at an angle and with a second leg portion aligned with said first leg portion having a blind bore therein and connectable to the non-conducting tubes.

5. In a vapor generator, the improvement claimed in claim 1, wherein the height of the non-conducting tube wall is from 300 mm to 3,000 mm.

6. A vapor generator, comprising wall means defining at least one pass, a stack connected to said at least one pass, a flue gas duct having one end connected to said stack and an opposite end connected to said at least one pass, said at least one pass having vapor-conducting tubes gas-tightly welded together and having non-conducting tubes arranged in spaced relationship to and following said conducting tubes in a direction toward said flue duct, said non-conducting tubes being gas-tightly welded together and through which the medium is not conducted.

7. A vapor generator, according to claim 6, wherein said non-conducting tubes are aligned with respective ones of said conducting tubes and including a transition piece interconnecting the associated ones of said conducting and non-conducting tubes and including a first leg portion connected to the conducting tubes and having a second leg portion disposed at an angle thereto for the offtake of the vapor and a third leg portion aligned with said first leg portion and being connected to the non-conducting tubes and terminating in a blind bore therein.

8. A vapor generator, according to claim 7, including a flat disposed between said conducting and said non-conducting tubes, adjacent ones of said transition pieces including a horizontal flat interconnecting said second leg portions of adjacent transition pieces.

9. A vapor generator, according to claim 6, wherein said at least one pass includes at least one first and at least one second pass, and a transition flue connected between said first pass and said second pass, said second pass extending downwardly from said transition flue and having its lower end connected to said flue gas duct, said non-conducting tubes being located below said conducting tubes.

10. A vapor generator, according to claim 6, wherein said at least one first gas pass includes a single pass tower vapor generator with said conducting tubes being located below said non-conducting tubes, said flue gas duct interconnecting the top of said tower vapor generator.

* * * * *